US007884297B2

(12) United States Patent
Okuzumi

(10) Patent No.: US 7,884,297 B2
(45) Date of Patent: Feb. 8, 2011

(54) ELECTRONIC APPARATUS

(75) Inventor: Tomoya Okuzumi, Tokyo (JP)

(73) Assignee: Panasonic Corporation, Osaka (JP)

( * ) Notice: Subject to any disclaimer, the term of this patent is extended or adjusted under 35 U.S.C. 154(b) by 303 days.

(21) Appl. No.: 11/993,100

(22) PCT Filed: Dec. 21, 2006

(86) PCT No.: PCT/JP2006/325519

§ 371 (c)(1),
(2), (4) Date: Dec. 19, 2007

(87) PCT Pub. No.: WO2007/097107

PCT Pub. Date: Aug. 30, 2007

(65) Prior Publication Data

US 2010/0219057 A1 Sep. 2, 2010

(30) Foreign Application Priority Data

Feb. 20, 2006 (JP) ..... 2006-042002

(51) Int. Cl.
*H01H 23/02* (2006.01)

(52) U.S. Cl. ..... 200/339; 200/315

(58) Field of Classification Search ..... 200/5 R, 200/5 A, 553, 557, 296, 339; 341/22, 35; 345/168, 169, 184
See application file for complete search history.

(56) References Cited

U.S. PATENT DOCUMENTS 4,332,991 A * 6/1982 Nordstrom ..... 200/409
4,401,864 A * 8/1983 Ichikawa ..... 200/17 R
4,689,455 A * 8/1987 Watanabe ..... 200/534
5,332,874 A * 7/1994 Orr et al. ..... 200/5 B
5,934,453 A * 8/1999 Sugawara et al. ..... 200/339
6,114,637 A * 9/2000 Nakao et al. ..... 200/5 R
6,239,726 B1 * 5/2001 Saida ..... 340/999
6,576,855 B2 * 6/2003 Levendis et al. ..... 200/339
6,963,039 B1 * 11/2005 Weng et al. ..... 200/302.1
7,094,983 B2 * 8/2006 Tsunemoto ..... 200/339

(Continued)

FOREIGN PATENT DOCUMENTS

JP 07-211195 A 8/1995

(Continued)

OTHER PUBLICATIONS

International Search Report for International Application No. PCT/JP2006/325519 dated Jan. 30, 2007.

(Continued)

*Primary Examiner*—Michael A. Friedhofer
(74) *Attorney, Agent, or Firm*—RatnerPrestia

(57) ABSTRACT

An electronic apparatus simplifies the structure of and facilitates the manufacture of the electronic apparatus having a seesaw-type operation button which is tiltable in a plurality of directions. The electronic apparatus has: an operation button; an operation panel provided with a holding portion for holding the operation button; and a plurality of switches to be pushed down by the operation button. The operation button comprises: a plurality of operating portions; a plurality of pressing portions respectively provided on the plurality of operating portions toward the plurality of switches; and a flat-shaped flexible board portion protruded between the plurality of pressing portions. The board portion is held by the holding portion.

8 Claims, 9 Drawing Sheets

U.S. PATENT DOCUMENTS

| | | | | |
|---|---|---|---|---|
| 7,105,762 | B1 * | 9/2006 | Lee | 200/449 |
| 7,217,898 | B2 * | 5/2007 | Chien et al. | 200/339 |
| 7,554,050 | B1 * | 6/2009 | Lv | 200/339 |

FOREIGN PATENT DOCUMENTS

| | | | |
|---|---|---|---|
| JP | 2001-503560 | A | 3/2001 |
| JP | 2003-86063 | A | 3/2003 |
| JP | 2006-049011 | | 2/2006 |

OTHER PUBLICATIONS

CN Office Action for corresponding CN Application No. 2006800176021 (with English translation), Oct. 16, 2009.

* cited by examiner

ELECTRONIC APPARATUS

This Application is a U.S. National Phase Application of PCT International Application PCT/JP2006/325519.

TECHNICAL FIELD

The present invention relates to an electronic apparatus provided with a seesaw-type operation button.

BACKGROUND ART

Conventional car audio equipment or other electronic apparatuses often have a seesaw-type operation button. FIGS. 11 and 12 show a conventional example, electronic apparatus 101. The electronic apparatus 101 comprises an operation button 103, a button holding member 105, and a substrate 107. The operation button 103 is held by the button holding member 105 so as to be tiltable to both sides. When the operation button 103 tilts, a switch 109*a* or 109*b* on the substrate 107 is pushed. The switches 109*a* and 109*b* are provided on both sides of the tilt center of the operation button 103. A configuration of this type is disclosed, for example, in Japanese Patent Laid-Open Application No. 7-211195 (FIGS. 1 and 2).

More particularly, the tilt structure of the operation button 103 is realized by a rotation structure comprising: a pivot portion 111 of the operation button 103; and a bearing portion 113 of the button holding member 107. The operation button 103 is tiltably held by the pivot portion 111 as a tilt fulcrum. The operation button 103 also has operating portions 121*a* and 121*b* on both sides of the tilt fulcrum. The operating portions 121*a* and 121*b* are portions to be pushed by an operator. Pressing portions 123*a* and 123*b* protrude from the operating portions 121*a* and 121*b* toward the switches 109*a* and 109*b*, and the tips of the pressing portions 123*a* and 123*b* are in contact with the switches 109*a* and 109*b*. When the operating portion 121*a* is pushed and the operation button 103 tilts, the pressing portion 123*a* presses the switch 109*a*. When the operating portion 121*b* is pushed and the operation button 103 tilts, the pressing portion 123*b* presses the switch 109*b*.

The electronic apparatus 1 has protrusions 125*a* and 125*b* as a configuration for locating the operation button 103 in a predetermined position (home position) in FIG. 11 in a neutral state where the operation button 103 is not operated. The protrusions 125*a* and 125*b* are provided on an edge portion of a button accommodating hole in the button holding member 105, and extend from both sides to the back of the operation button 103. When the operation button 103 is pushed by an operator and tilts, the protrusion 125*a* (or the protrusion 125*b*) on the pushed side bends and elastically deforms. And then, when the finger of the operator leaves the operation button 103, the form of the protrusion 125*a* (or the protrusion 125*b*) is restored, and the operation button 103 returns to the original predetermined position.

In the conventional electronic apparatus, however, since the tilt structure is made up of the pivot portion 111 and its bearing portion 113, the structure of the forming mold is complicated. Every component requires high precision, so it would not be easy to manufacture.

DISCLOSURE OF THE INVENTION

Problems to be Solved by the Invention

A purpose of the invention made in the above-mentioned background is to provide an electronic apparatus that has a tiltable operation button, has a simple structure, and is easy to manufacture.

Means for Solving the Problems

An electronic apparatus of the invention has: an operation button; an operation panel provided with a holding portion for holding the operation button; and a plurality of switches to be pushed down by the operation button, wherein the operation button includes: a plurality of operating portions; a plurality of pressing portions respectively provided on the plurality of operating portions toward the plurality of switches; and a flat-shaped flexible board portion protruded between the plurality of pressing portions, the board portion of the operation button for being held by the holding portion.

An electronic apparatus consistent with another aspect of the invention has: an operation button; a button holding member provided with a holding portion for holding the operation button; and a plurality of switches to be pushed down by the operation button, wherein the operation button includes: a plurality of operating portions; and a plurality of pressing portions respectively provided on the plurality of operating portions toward the plurality of switches, the operation button and the holding portion are configured to be connected to each other between the plurality of pressing portions via a flexible bending member, both ends of the bending member being fixed to the operation button and the holding portion, respectively. The bending member may be, but is not limited to, the above-described board portion.

There are other aspects of the invention as described below. This disclosure of the invention therefore intends to provide part of aspects of the invention and does not intend to limit the scope of the invention described and claimed herein.

DESCRIPTION OF THE SYMBOLS

Figure 1:
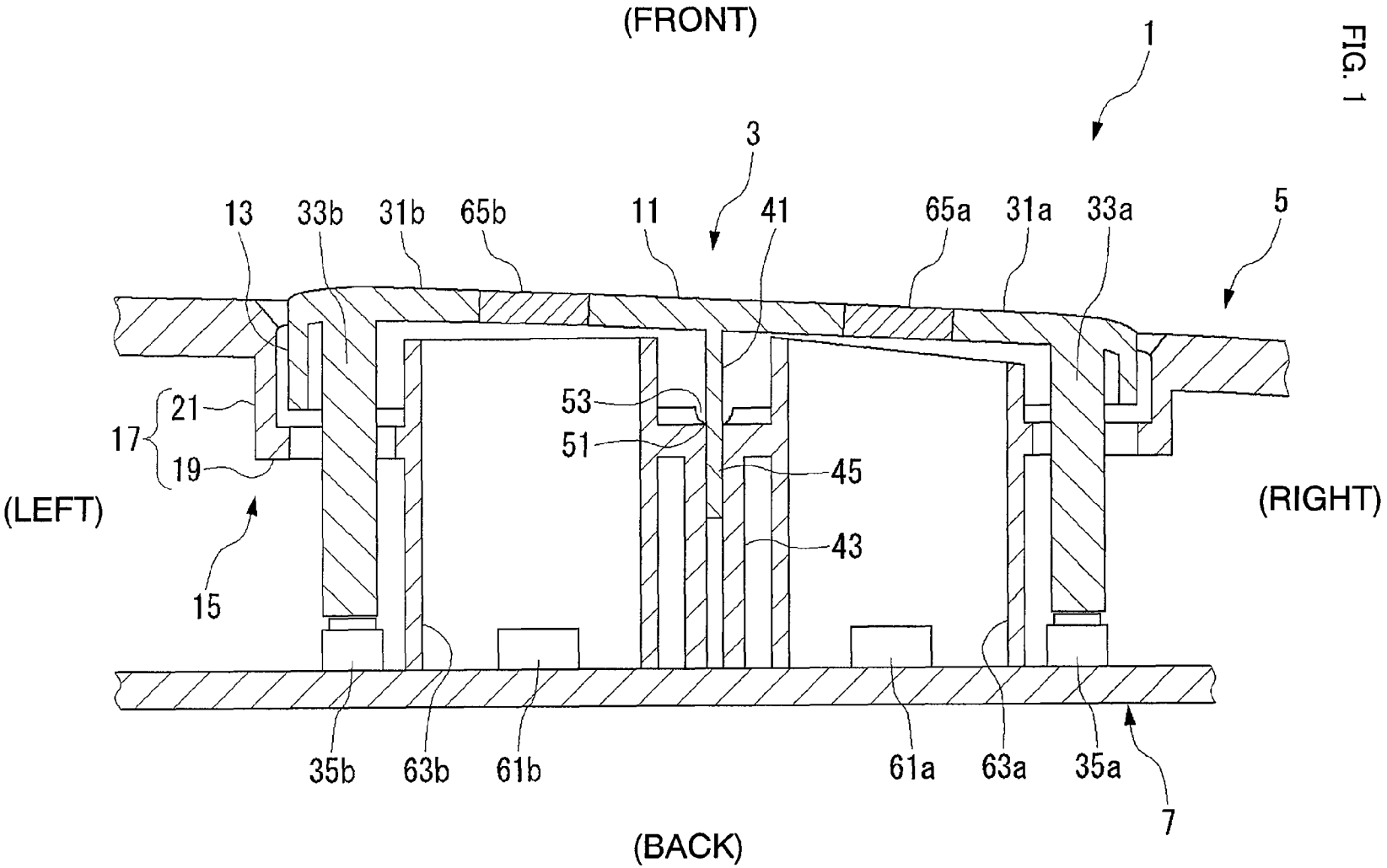
FIG. 1 is a cross section of an electronic apparatus in an embodiment of the invention.

1: Electronic apparatus
3: Operation button
5: Operation panel
7: Substrate
9: Chassis
11: Face board portion
15: Holding portion
31*a*, 31*b*: Operating portion
33*a*, 33*b*: Pressing portion
35*a*, 35*b*: Switch
41: Hinge board portion
43: Holding boss
45: Holding hole
47*a*, 47*b*: Claw portion
49: Slit
51: Partially abutting portion
53: Fulcrum protrusion
61*a*, 61*b*: Light-emitting portion
63*a*, 63*b*: Tubular portion
65*a*, 65*b*: Illumination window portion

BEST MODE OF EMBODYING THE INVENTION

Now, the invention will be described in detail. However, the following detailed description and appended drawings are not intended to limit the invention. Rather, the scope of the invention is defined by the appended claims.

An electronic apparatus of the invention has: an operation button; an operation panel provided with a holding portion for holding the operation button; and a plurality of switches to be pushed down by the operation button, wherein the operation button includes: a plurality of operating portions; a plurality of pressing portions respectively provided on the plurality of operating portions toward the plurality of switches; and a flat-shaped flexible board portion protruded between the plurality of pressing portions, the board portion of the operation button for being held by the holding portion.

In this configuration, the board portion of the operation button is held by the holding portion of the operation panel. The board portion bends and functions as a hinge, and thereby the operation button is tiltably held. In a neutral state where the operation button is not operated, the operation button is held in a position and attitude where the board portion does not bend. In this manner, with the simple bending structure having the board portion, the invention can realize a tilt function and can also realize a holding function in a predetermined position in the neutral state. The invention can therefore provide an electronic apparatus that has a tiltable operation button, has a simple structure, and is easy to manufacture.

In the electronic apparatus, a partially abutting portion may be provided adjacent to the board portion so as to providing partial contact between the operation button and the operation panel. In this configuration, the partially abutting portion acts as a tilt fulcrum (tilt support), the fulcrum of the tilt movement (seesaw movement) stabilizes, and the button can be operated more reliably.

The holding portion may have a holding hole, the board portion may be held inserted in the holding hole, and the holding hole may be provided with a chamfered portion at an entrance portion thereof. In this configuration, the board portion can be bent smoothly according to the tilt of the operation button around the tilt fulcrum, and stress concentration in the board portion can be reduced.

A holding hole may be provided through the holding portion, the board portion may have a claw portion, and an edge portion of the holding hole and the claw portion may engage with each other so that the operation button is held by the holding portion. In this configuration, the operation button can be held by the operation panel with a simple structure.

The board portion may have a plurality of the claw portions, and a slit may be provided between the plurality of claw portions. In this configuration, since the claw portions bend, the board portion can be easily inserted into the through holding hole and assembly characteristics are improved. In addition, the height of the claw portions can be increased, so the operation button can be mounted on the operation panel more reliably.

The holding portion may be integrally formed on the operation panel. In this configuration, a button rest provided on the operation panel functions as the button holding portion. The button holding portion can be realized with the simple configuration where only a button rest is provided on the operation panel, the number of parts can be reduced, and assembly characteristics can be improved.

A light-emitting portion may be provided near the switches, and the operation panel may have a tubular portion in a position corresponding to the light-emitting portion so as to allow light to pass from the light-emitting portion to the operating portion. In this configuration, the operation button can be illuminated with light from the light-emitting portion. Since button hold in the predetermined position in the neutral state is realized by the above-mentioned board portion, the tubular portion can be suitably provided without being obstructed by a protruding member behind the button which is seen in conventional apparatuses. Consequently, the operation button can be suitably illuminated with light from the light-emitting portion.

In another aspect, an electronic apparatus has: an operation button; a button holding member provided with a holding portion for holding the operation button; and a plurality of switches to be pushed down by the operation button, wherein the operation button includes: a plurality of operating portions; and a plurality of pressing portions respectively provided on the plurality of operating portions toward the plurality of switches, the operation button and the holding portion are configured to be connected to each other between the plurality of pressing portions via a flexible bending member, both ends of the bending member being fixed to the operation button and the holding portion, respectively. The bending member may be, but is not limited to, the above-described board portion. Two or more bending directions may be enough for the bending member. With the simple structure having the bending member, the configuration realizes the tiltable structure and the structure in which the operation button is held in the predetermined position in the neutral state. Consequently, this configuration can also provide an electronic apparatus that has a tiltable operation button, has a simple structure, and is easy to manufacture.

As described above, having adopted the construction where the operation button is held by the bending hinge structure of the board portion or the like, the invention can provide an electronic apparatus having advantages that the electronic apparatus provided with a tiltable operation button is made simple in structure and can be easily manufactured.

Now, an electronic apparatus consistent with an embodiment of the invention will be described with reference to the drawings.

Figure 7:
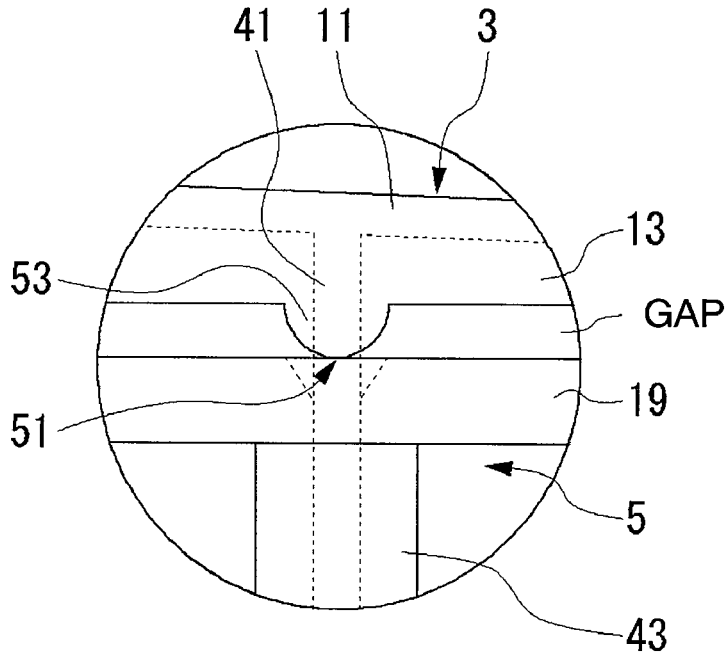
FIG. 7 is an enlarged cross section of a partially abutting portion of the operation button.
Figure 8:
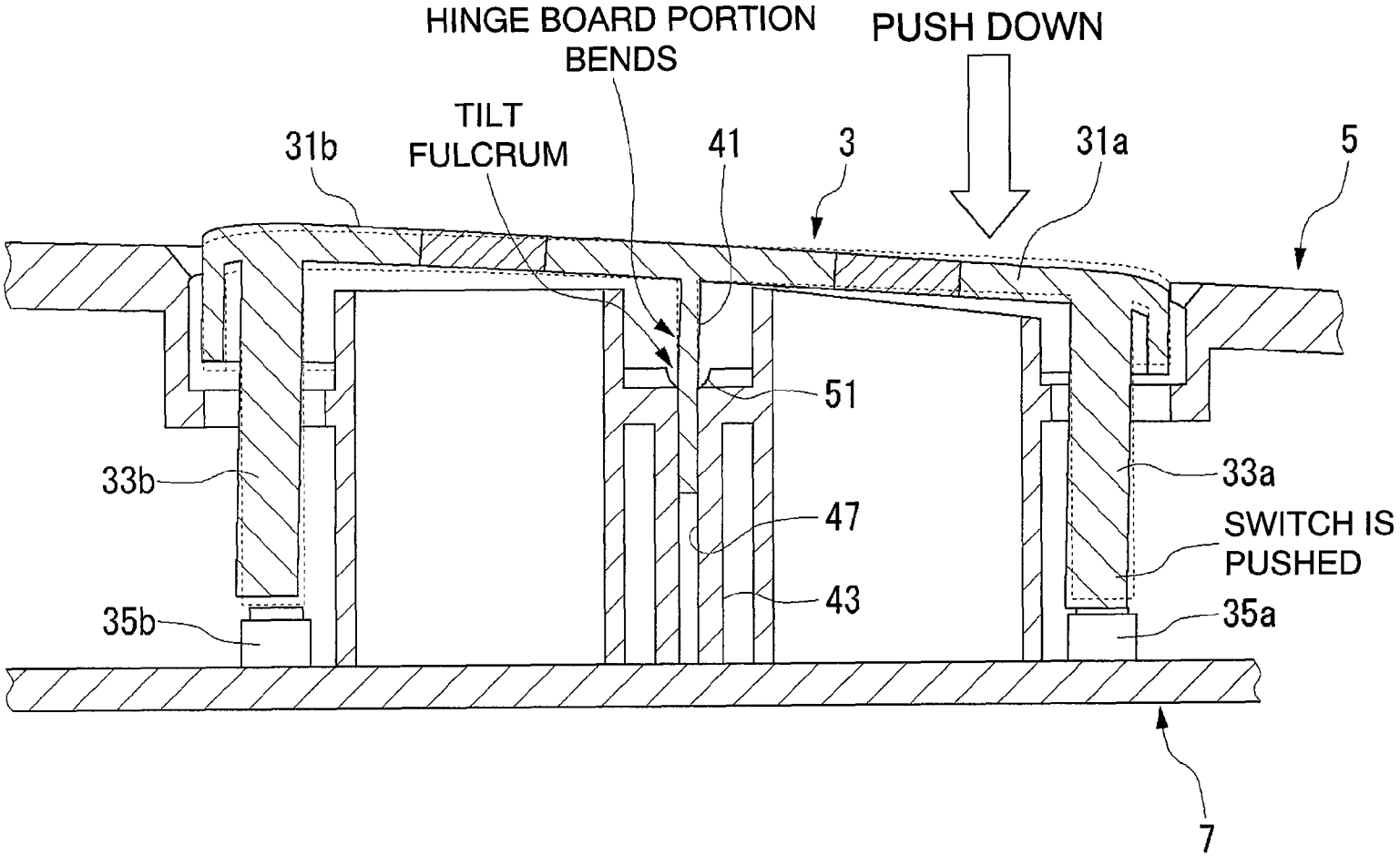
FIG. 8 shows a movement of the electronic apparatus at the time of button operation.
Figure 9:
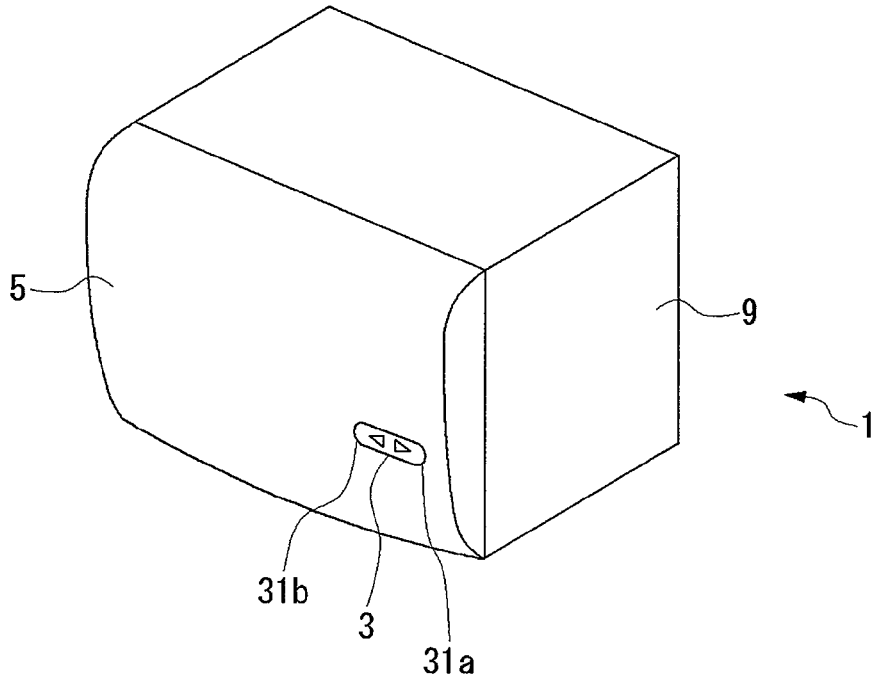
FIG. 9 is a perspective view showing a general configuration of the electronic apparatus.
Figure 10:
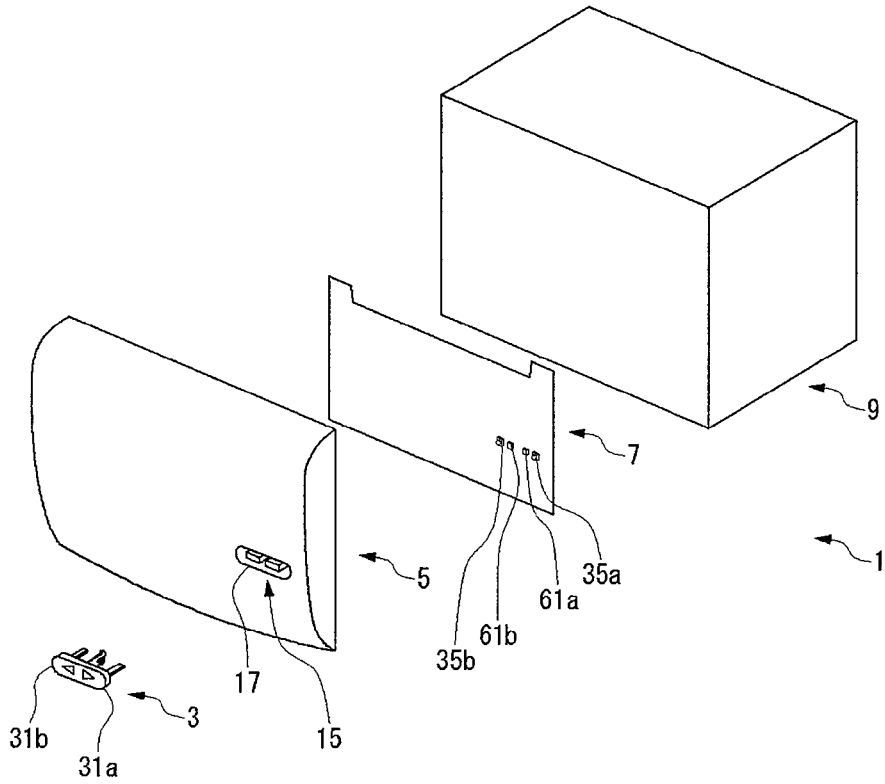
FIG. 10 is an exploded perspective view showing the general configuration of the electronic apparatus.

The electronic apparatus consistent with the embodiment of the invention is shown in FIGS. 1 to 10. In these figures, FIGS. 9 and 10 show a general configuration of the electronic apparatus 1, and FIGS. 1 to 8 show a configuration of an operation button part provided on the electronic apparatus 1.

The general configuration will first be described with reference to FIGS. 9 and 10. As shown in the figures, the electronic apparatus 1 comprises an operation button 3, an operation panel 5, a substrate 7, and a chassis (case) 9. The operation panel 5 is attached to the front of the chassis 9, and the operation button 3 is held by the operation panel 5 tiltably to both sides of left and right. The substrate 7 is attached to the backside of the operation panel 5 with screws or the like. The substrate 7 has a switch to be pushed by a button operation.

In the embodiment, the electronic apparatus 1 is, for example, car audio equipment. The invention is particularly useful for electronic apparatuses, such as car audio equipment and other vehicle-mounted apparatuses, which are used under circumstances in which they are often affected by vibration. The invention, however, is not limited to car audio equipment and vehicle-mounted equipment. The invention may be applied to other kinds of electronic apparatuses.

The operation button 3 of the embodiment is a seesaw-type button tiltable in a plurality of directions. The operation button 3 is used, for example, for up/down operation of the receiving frequency in radio mode. The operation button 3 is also used, for example, for up/down operation of the tracks of a CD or MD at the time of playback. As above, a plurality of paired operation functions are assigned to the operation button 3. This allows a plurality of paired operating sections to be discriminated from other operating sections, so that it becomes easy to distinguish those operating sections, it also becomes easy to operate without looking at them, and operability can be improved. The invention, however, does not limit what kind of operation the operation button 3 is applied to.

While one operation button 3 is shown in FIGS. 9 and 10, it is a matter of course that a plurality of operation buttons 3 may be provided. Though not shown, another kind of operation button that is not seesaw-type may also be provided on the operation panel 5 in an actual electronic apparatus 1. A dial or another kind of operating member may be provided. Moreover, a display can also be provided on the operation panel. These components, however, are omitted from the figures because they are not required for a description of the operation button 3 that is characteristic of the invention.

In the following, the operation button 3 and the holding structure thereof will be described in detail. In the description below, the front side of the electronic apparatus 1 is called "front," and the backside is called "back," if required. "Up," "down," "left," "right," "horizontal," "vertical," and the like mainly mean the directions of the electronic apparatus 1 viewed from the front.

Figure 2:
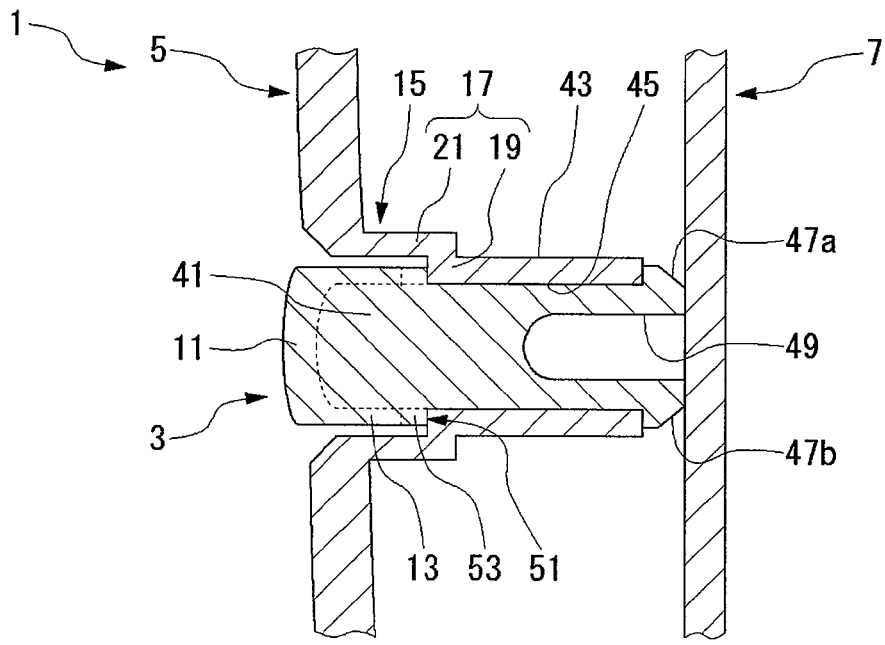
FIG. 2 is a cross section of the electronic apparatus in the embodiment of the invention.
Figure 4:
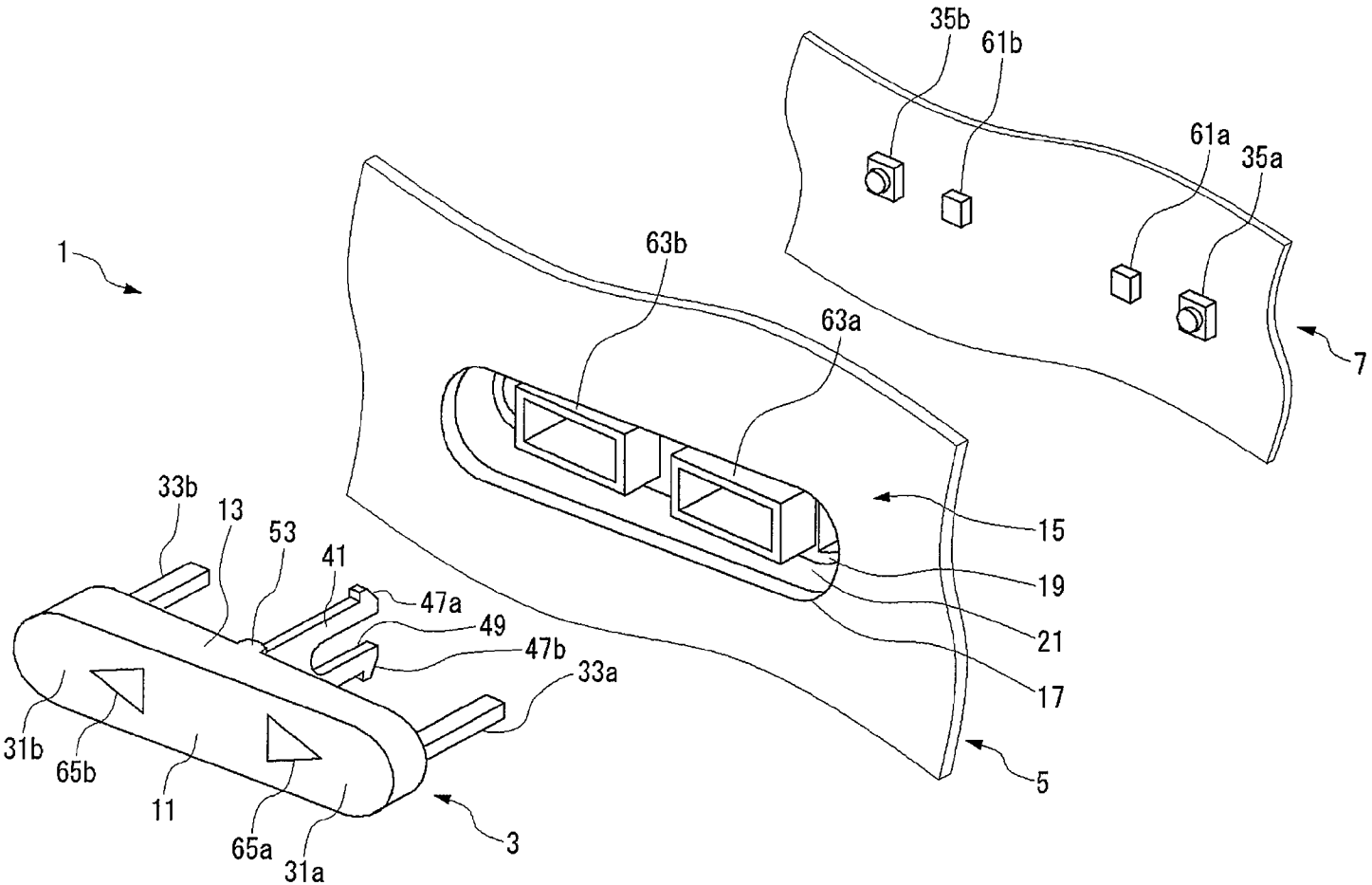
FIG. 4 is an exploded perspective view of the electronic apparatus in the embodiment of the invention viewed diagonally from the front.
Figure 5:
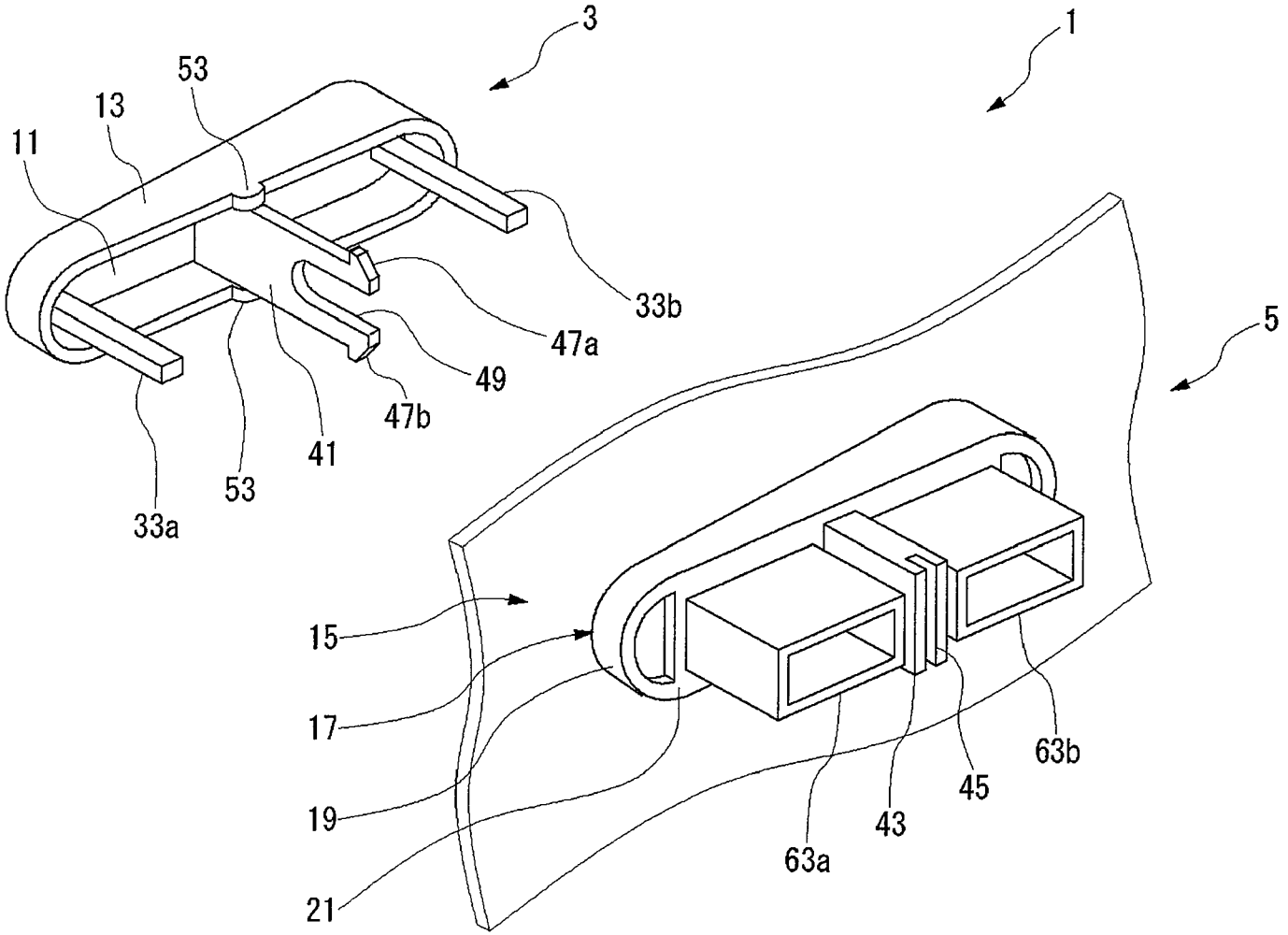
FIG. 5 is an exploded perspective view of the electronic apparatus in the embodiment of the invention viewed diagonally from the back.

FIGS. 1 and 2 are a transverse cross section and longitudinal cross section of the operation button 3. FIG. 1 is a cross section of the electronic apparatus 1 cut along the line AA in FIG. 3, a front view, where the line AA passes through the center of the operation button 3. FIG. 2 is a cross section of the electronic apparatus 1 cut along the line BB in FIG. 3, the front view, where the line BB passes through the tilt center (tilt fulcrum or tilt support) at the center of the operation button 3. FIGS. 4 and 5 are exploded perspective views of the section of the operation button 3 viewed diagonally from the front and diagonally from the back.

The operation button 3 is an integrally formed resin member. In the embodiment, the material of the operation button 3 is ABS polycarbonate. The operation button 3 has a face board portion 11 exposed in the front, and an edge wall portion 13 provided on an edge of the face board portion 11. The face board portion 11 has an elliptical shape in which a horizontally long rectangular is combined with semicircles at both end. The edge wall portion 13 is provided on a periphery of the face board portion 11, and extends toward the back.

The operation panel 5 has a holding portion 15 for holding the operation button 3. The holding portion 15 is integrally formed on the operation panel 5. The holding portion 15, however, may be made separately from and be attached to the operation panel 5.

The holding portion 15 is formed with a hollow holding portion 17 for accommodating the operation button 3. The hollow holding portion 17 functions as a button rest and accepts the operation button 3. The hollow holding portion 17 is formed with a bottom board portion 19 and a peripheral wall portion 21. The peripheral wall portion 21 surrounds the operation button 3, and comes close to the edge wall portion 13.

A plurality of operating portions 31*a* and 31*b* are provided on both sides of left and right, of a center of the operation button 3. The operating portions 31*a* and 31*b* are portions to be pushed by an operator. That is, areas on the left and right of the face board portion 11 correspond to the operating portions 31*a* and 31*b*.

Pressing portions 33*a* and 33*b* protrude backward from the operating portions 31*a* and 31*b*, respectively. The pressing portions 33*a* and 33*b* are rod-type pillar-shaped protrusions extending from the backside of the face board portion 11 near both left and right ends thereof toward the substrate 7 in the back. The pressing portions 33*a* and 33*b* pass through holes provided in the bottom board portion 19 of the hollow holding portion 17 of the operation panel 5.

The substrate 7 has switches 35*a* and 35*b* on both sides of the tilt fulcrum of the operation button 3. The switches 35*a* and 35*b* are located opposite to the pressing portions 33*a* and 33*b*. The pressing portions 33*a* and 33*b* extend toward the switches 35*a* and 35*b*, and the tips of the pressing portions 33*a* and 33*b* are in contact with the switches 35*a* and 35*b*.

In FIG. 1 the operation button 3 is in a neutral state where it is not pushed by an operator. End portions of the pressing portions 33*a* and 33*b* lightly push the switches 35*a* and 35*b* in this state. The switches 35*a* and 35*b* are pushed with a strength not to close the contacts. The force given in advance to the switches 35*a* and 35*b* as above is called "pre-tension". As shown in the figure, both of the switches 35*a* and 35*b* are pre-tensioned. Various dimensions such as the lengths of the pressing portions 33*a* and 33*b* are set so as to obtain the above contact state. Dimensional tolerances are also considered so that the pre-tension is loaded reliably.

The structure for tiltably holding the operation button 3 will be described next. The operation button 3 has a hinge board portion 41 between the pressing portions 33*a* and 33*b*. The hinge board portion 41 is located in approximately the center of the operation button 3, and protrudes backward from the backside of the face board portion 11. The hinge board portion 41 corresponds to the board portion of the invention.

The hinge board portion 41 is a thin flat-shaped member. The hinge board portion 41 is quadrangular in a cross section perpendicular to the direction of protrusion (i.e. the depth direction of the electronic apparatus 1). In the quadrangular cross section, the direction along the long side is called a "width direction", and the direction along the short side is called a "thickness direction". The hinge board portion 41 is placed so that the thickness direction corresponds to the direction connecting the operating portions 31*a* and 31*b* on both sides of the operation button 3 (the left-right direction), and the direction that is every time (i.e. in both states where the hinge board portion 41 is bent and where it is not) orthogonal to the width direction of the hinge board portion 41 and corresponds to the thickness direction is called a "tilt direction". The hinge board portion 41 is held by the below-described configuration so that these width direction, thickness direction, and tilt direction are realized. The dimension of the hinge board portion 41 in the thickness direction, namely the board thickness, is for example 0.8 mm to 1 mm.

The hinge board portion 41 is held by the holding boss 43 provided on the holding portion 15 of the operation panel 5. The holding boss 43 is integrally formed on the operation panel 5. The holding boss 43 is a pillar-shaped boss extending backwards from the bottom board portion 19 of the hollow holding portion 17. The tip of the holding boss 43 reaches the substrate 7. A holding hole 45 is provided in the front-rear direction through the holding boss 43. The hinge board portion 41 is held inserted in the holding hole 45.

Here, the front end of the holding hole 45 is called an "entrance", and the rear end is called an "exit". The entrance is an end portion near the face board portion 11 of the operation button 3, and the exit is an end portion near the substrate 7.

As shown in the figures, the hinge board portion 41 is partially inserted in the holding hole 45, and the rest is out of the entrance. More particularly, approximately two thirds of the hinge board portion 41 is inside the holding hole 45, and approximately one third of the hinge board portion 41 is outside the holding hole 45. This outside portion leads to the back surface of the face board portion 11 of the operation button 3. This outside portion bends when the operating portion 31*a* or 31*b* of the operation button 3 is pushed. In this way, the hinge board portion 41 functions as a hinge, and the operation button 3 tilts. The hinge board portion 41 is flexible enough to function as a hinge and tilt the operation button 3. In the embodiment, this flexibility is achieved by the material of the operation button 3, which is ABS polycarbonate, and by the above-described board thickness (about 0.8 to 1 mm).

The tip of the hinge board portion 41 reaches the substrate 7. The hinge board portion 41 has claw portions 47*a* and 47*b* on both sides of the tip portion. As shown in FIG. 2, the claw portions 47*a* and 47*b* are engaged to an edge portion on the exit side of the holding hole 45. More particularly, the holding boss 43 has cuts in the exit portion of the holding hole 45. The cuts are provided on both sides of the hinge board portion 41 in the width direction (the direction orthogonal to the thickness direction). In this manner, the two cuts are provided in positions corresponding to the two claw portions 47*a* and 47*b*, which are engaged to these cuts, respectively. This engagement prevents the hinge board portion 41 from coming out of the holding hole 45, and allows the operation button 3 to be reliably held by the holding portion 15.

As shown in the figure, the hinge board portion 41 has a slit 49 that reaches around the center from the tip portion. The slit 49 is provided between the claw portions 47*a* and 47*b*. The provided slit allows the claw portions 47*a* and 47*b* to bend inside when the hinge board portion 41 is inserted into the holding hole 45. This allows the hinge board portion 41 to be easily inserted into the holding hole 45, and improves assembly characteristics. In addition, the claw portions 47*a* and 47*b* can be raised, so that the operation button 3 can be held reliably.

Figure 3:
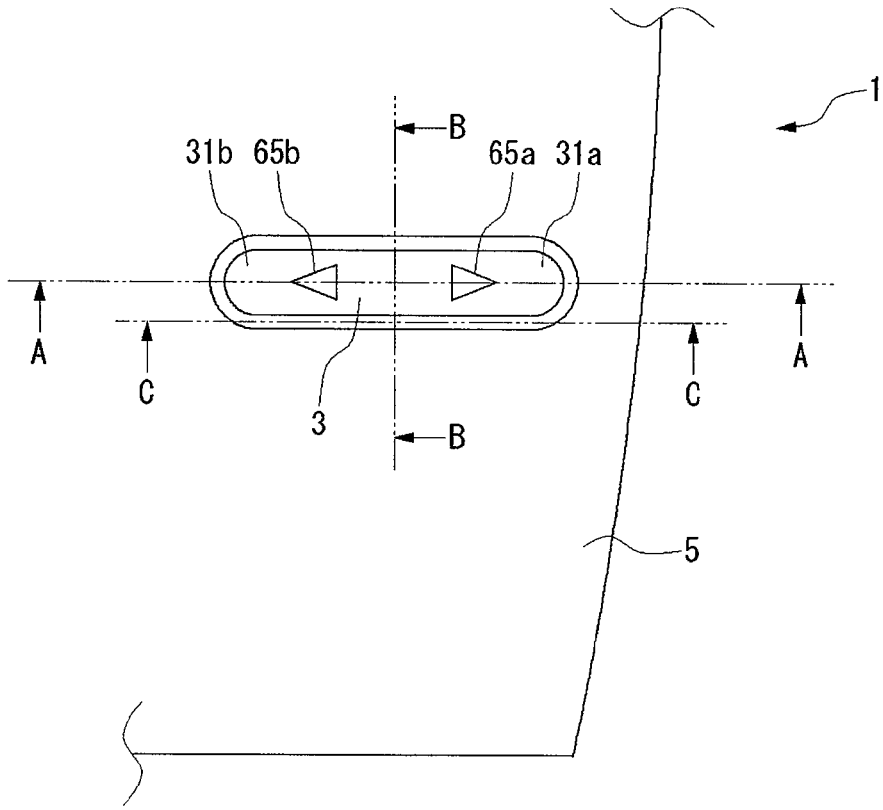
FIG. 3 is a front view of the electronic apparatus in the embodiment of the invention.
Figure 6:
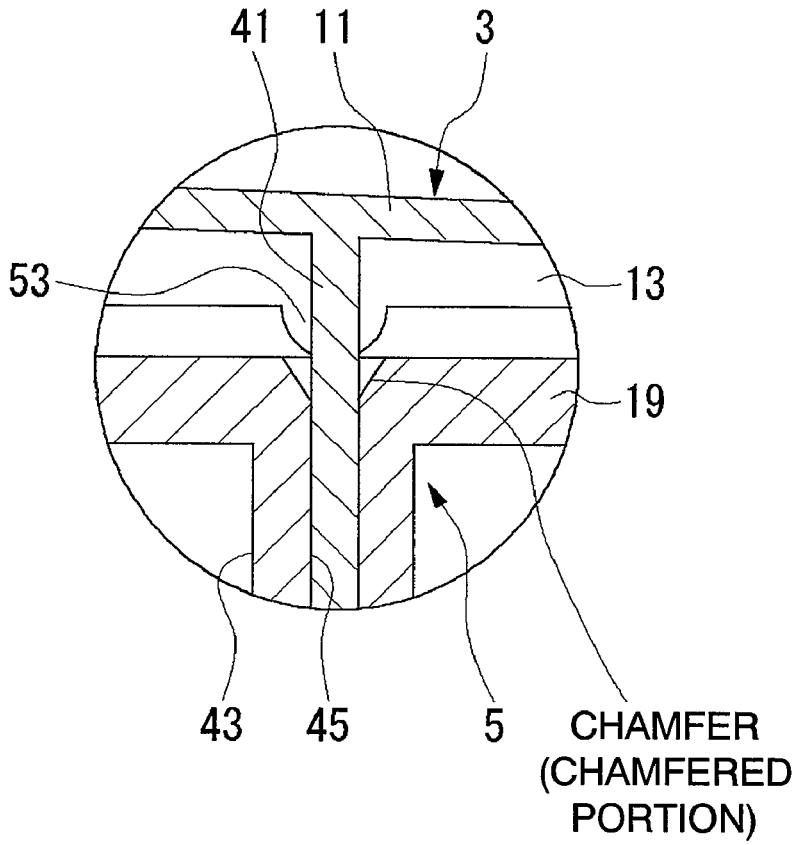
FIG. 6 is an enlarged view of a hinge board portion of an operation button and its holding hole.

FIG. 6 is an enlarged view of the entrance portion of the holding hole 45 in FIG. 3. The entrance portion of the holding hole 45 is obliquely cut as shown in the figure to be provided with a chamfer (chamfered portion). Since the chamfer is provided, when the operation button 3 tilts around the below-described tilt fulcrum, the hinge board portion 41 bends in space cut out for the chamfer. The space for the hinge board portion 41 to bend is thus formed. The formed space allows the hinge board portion 41 to bend easily. Since the hinge board portion 41 becomes easy to bend, stress concentration is reduced.

As shown in FIGS. 1 and 2, the electronic apparatus 1 has a partially abutting portion 51 adjacent to the hinge board portion 41. The partially abutting portion 51 is a portion at which the operation button 3 and the operation panel 5 are in partial contact with each other.

FIG. 7 is a cross section of the electronic apparatus 1 cut along the line CC in FIG. 3 so as to allow the partially abutting portion 51 to be viewed easily. As shown in FIG. 7, the partially abutting portion 51 is realized in the embodiment with two semicircular fulcrum protrusions 53 provided on top of the edge wall portion 13 of the operation button 3. The tips of the fulcrum protrusions 53 are in contact with the bottom board portion 19 of the hollow holding portion 17 in the holding portion 15 of the operation panel 5.

The two fulcrum protrusions 53 are located in approximately the center of the operation button 3 in the direction connecting the operating portions 31*a* and 31*b* on both sides (the left-right direction), and are provided on both sides of the hinge board portion 41 in the width direction. Consequently, the partially abutting portion 51 is located adjacent to the hinge board portion 41. More particularly, the partially abutting portion 51 is in the same position as the hinge board portion 41 when viewed along the bending direction (the above-mentioned direction connecting the operating portions 31*a* and 31*b*, which is the direction corresponding to the thickness direction at a time when the hinge board portion 41 is not bending), and is on both sides of the hinge board portion 41 when viewed along the direction orthogonal to the bending direction.

At the tip of the fulcrum protrusion 53, the operation button 3 has line contact with the bottom board portion 19 of the hollow holding portion 17 in the holding portion 15 of the operation panel 5. When viewed from the direction of FIG. 1 (when viewed from the direction intersecting the bending direction), the edge wall portion 13 of the operation button 3 has point contact with the bottom board portion 19 of the operation panel 5. As a result, outside the partially abutting portion 51, space is left between the edge wall portion 13 of the operation button 3 and the bottom board portion 19 of the operation panel 5. That is, the operation button 3 is held lifted from the operation panel 5 outside the partially abutting portion 51. When the operating portion 31*a* or 31*b* of the operation button 3 is pushed, the partially abutting portion 51 acts as the tilt fulcrum, the hinge board portion 41 bends, and the operation button 3 tilts. At this time, since the chamfer is provided at the entrance portion of the holding hole 47 for the holding boss 45 as described above (FIG. 6), the bending is not obstructed by the holding boss 45 and the hinge board portion 41 can smoothly bend.

While in the embodiment the fulcrum protrusions 53 are provided on the operation button 3, variations may be made within the scope of the invention. For example, a fulcrum protrusion may be provided on the operation panel 5. Also while in the above embodiment the fulcrum protrusion is semicylindrical in shape with a semicircular cross section (a shape formed by cutting a cylinder with a plane that passes through a diameter of the cylinder and is orthogonal to the circle), the operation button 3 can perform the seesaw movement even if the fulcrum protrusion is not semicylindrical in shape. For example, the shape of the fulcrum protrusion may be a triangular prism, or may be a semisphere. However, if the shape is a triangular prism, the tip portion would wear from use and the fulcrum protrusion would become trapezoidal in shape, which causes a rattle at the time of operation. If the shape is a semisphere, the contact zone of the fulcrum would cause a point contact and, also in this case, the top portion could wear and a rattle could thereby occur. Considering these points, the semicylindrical fulcrum protrusion of the embodiment is advantageous because it is hard to wear at the tip and consequently a rattle is not likely to occur.

An illumination-related configuration of the operation button 3 will be described next. The substrate 7 is provided with light-emitting portions 61*a* and 61*b* near and inside the switches 35*a* and 35*b*. A light-emitting component for the light-emitting portions 61*a* and 61*b* is typically an LED. The light-emitting component may be a lamp. The operation panel 5 is provided with tubular portions 63*a* and 63*b* in positions corresponding to the light-emitting portions 61*a* and 61*b*. The tubular portions 63*a* and 63*b* transmit light from the light-emitting portions 61*a* and 61*b* toward the operation button 3. The tubular portions 63*a* and 63*b* are also integrally formed on the operation panel 5.

The tubular portions 63*a* and 63*b* are located nearer the center of the button than the pressing portions 33*a* and 33*b*. The tubular portion 63*a* is situated between the pressing portion 33*a* and the holding boss 45, and the tubular portion 63*b* is situated between the pressing portion 33*b* and the holding boss 45. The tubular portions 63*a* and 63*b* extend forward and backward from the bottom board portion 19 of the hollow holding portion 17 in the holding portion 15 of the operation panel 5. The tubular portions 63*a* and 63*b* have entrance end portions on the side of the substrate 7, and have exit end portions on the side of the operation button 3. The entrance end portions reach the substrate 7, and the end portions surround the light-emitting portions 61*a* and 61*b*. The exit end portions are located near the operation button 3 with their exit openings facing toward the back surface of the face board portion 11. The tubular portions 63*a* and 63*b* provide a light shield function that prevents light from the light-emitting portions 61*a* and 61*b* from leaking to the surroundings, and appropriately guide light to the operation button 3.

The face board portion 11 of the operation button 3 has illumination window portions 65*a* and 65*b* on the operating portions 31*a* and 31*b*. The illumination window portions 65*a* and 65*b* are provided in positions corresponding to the exit openings of the tubular portions 63*a* and 63*b*. The illumination window portions 65*a* and 65*b* are semitransparent and can transmit light. The illumination window portions 65*a* and 65*b* may be provided, with the operation button 3 whose material being a transparent resin and with part of the face board portion 11 outside the windows being painted. The illumination window portions 65*a* and 65*b*, for example, have shapes shown in FIG. 3. The shapes of the illumination window portions 65*a* and 65*b* may be characters (e.g. "up" and "down").

There has been described a configuration of the electronic apparatus 1 consistent with the embodiment. Now, an example of assembly sequence for the electronic apparatus 1 will be described. A general assembly sequence is as follows. First, the operation button 3 is inserted and attached to the operation panel 5 from the front side. Next, the substrate 7 is fixed on the backside of the operation panel 5 with screws or the like. And then, the operation panel 5 is attached to the chassis 9. Various electronic components have been put in the chassis 9 in advance.

The attachment method for the operation button 3 will be described in more detail. The operation button 3 is fitted into the hollow holding portion 17 of the operation panel 5. At this time, the hinge board portion 41 of the operation button 3 is inserted into the holding hole 45 of the holding boss 43. Since the slit 49 is provided, the claw portions 47*a* and 47*b* at the tip of the hinge portion 41 easily bend inside (that is, in the direction in which the claw portions 47*a* and 47*b* get closer to each other). The hinge portion 41 is then smoothly inserted into the holding hole 45. When the claw portions 47*a* and 47*b* of the hinge portion 41 pass through the holding hole 45 and reach the cuts in the engagement part, the bending disappears and the claw portions 47*a* and 47*b* recover their original shapes. The claw portions 47*a* and 47*b* are engaged to edge portions of the holding hole 45. The operation button 3 is thus held by the holding portion 15 of the operation panel 5. In the state where the operation button 3 is held, the operation button 3 is in contact with the holding portion 15 of the operation panel 5 at the partially abutting portion 51, and outside that place a gap is left between the operation button 3 and the operation panel 5. The pressing portions 33*a* and 33*b* on both sides are held in the pre-tension position to lightly push the switches 35*a* and 35*b*.

The above-described assembly sequence of the electronic apparatus 1 may be suitably changed. For example, the operation button 3 may be attached to the operation panel 5 after the substrate 7 is mounted on the operation panel 5. For another example, the operation button 3 may be attached to the operation panel 5 after the operation panel 5 is mounted on the chassis 9. These various assembly sequences can be adopted since the operation button 3 can be easily mounted from the front side.

A movement of the electronic apparatus 1 consistent with the embodiment will be described next. When the operation button 3 is not operated, the operation button 3 is held in the neutral state in FIG. 1. At this time, since the operation button 3 is not under the action of external force, the hinge board portion 41 is not bent but straight. The pressing portions 33*a* and 33*b* push the switches 35*a* and 35*b* with light force not to close the contacts. The operation button 3 therefore does not generate the sound of collision or the like due to the influence of vibration.

As shown in FIG. 8, suppose the operating portion 31*a* of the operation button 3 is pushed by an operator. In this case, the hinge board portion 41 elastically deforms to bend, and the operation button 3 tilts to the side of the operating portion 31*a*. At this time, the partially abutting portion 51 acts as the tilt fulcrum, and the operation button 3 rotates against the operation panel 5 and tilts. The pressing portion 33*a* then presses the switch 35*a*, the contacts of the switch 35*a* close, and the electronic apparatus 1 performs an action corresponding to the operation. When the hand is taken off the operating portion 31*a*, the bending of the hinge board portion 41 disappears and the hinge board portion 41 recovers the original straight shape. The contacts of the switch 35*a* then open, and the operation button 3 returns to the neutral state in FIG. 1.

Suppose the operating portion 31*b* of the operation button 3 is pushed. The movement at this time is a bending movement in a bending direction opposite to the bending direction of the hinge board portion 41 according to the above-described movement. The hinge board portion 41 bends the other way, the operation button 3 tilts, the switch 35*b* is pushed by the pressing portion 33*b*, and the contacts close. When the hand is taken off the operating portion 31*b*, the bending of the hinge board portion 41 disappears and the hinge board portion 41 recovers the original straight shape.

The contacts of the switch 35*b* then open, and the operation button 3 returns to the neutral state in FIG. 1.

There has been described the electronic apparatus 1 consistent with the embodiment of the invention. In the embodiment, the flexible board portion 41 (the hinge board portion 41 in the above description) is protruded between the plurality of pressing portions 31*a* and 31*b* of the operation button 3, and the board portion 41 is held by the holding portion 15 of the operation panel 5. The board portion 41 bends and functions as a hinge, and thereby the operation button 3 is tiltably held. In the neutral state where the operation button 3 is not operated, the operation button 3 is held in the position and attitude where the board portion 41 does not bend. Consequently, with the simple bending structure having the board portion 41, the invention can realize the tilt function and can also realize the holding function in a predetermined position in the neutral state. A rotation structure like the conventional art is not required. A special member is not required to be provided such as a protrusion extending around the button from both sides to the back, while it is required for the conventional art. In this way, the electronic apparatus 1 can be provided that has a simple structure and is easy to manufacture.

Figure 11:
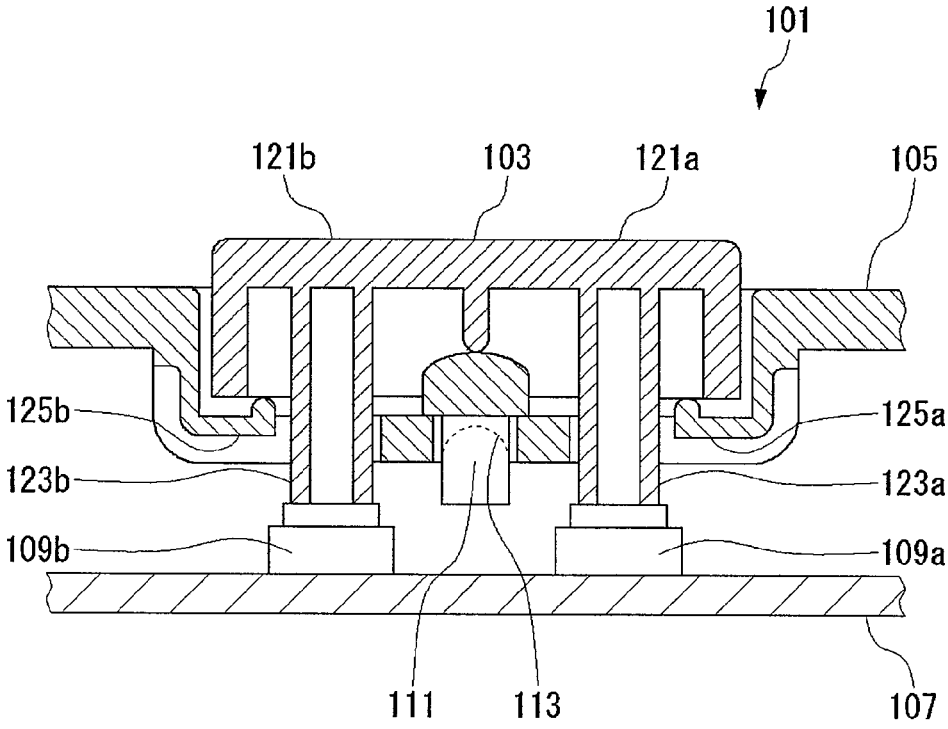
FIG. 11 is a perspective view of a conventional electronic apparatus.
Figure 12:
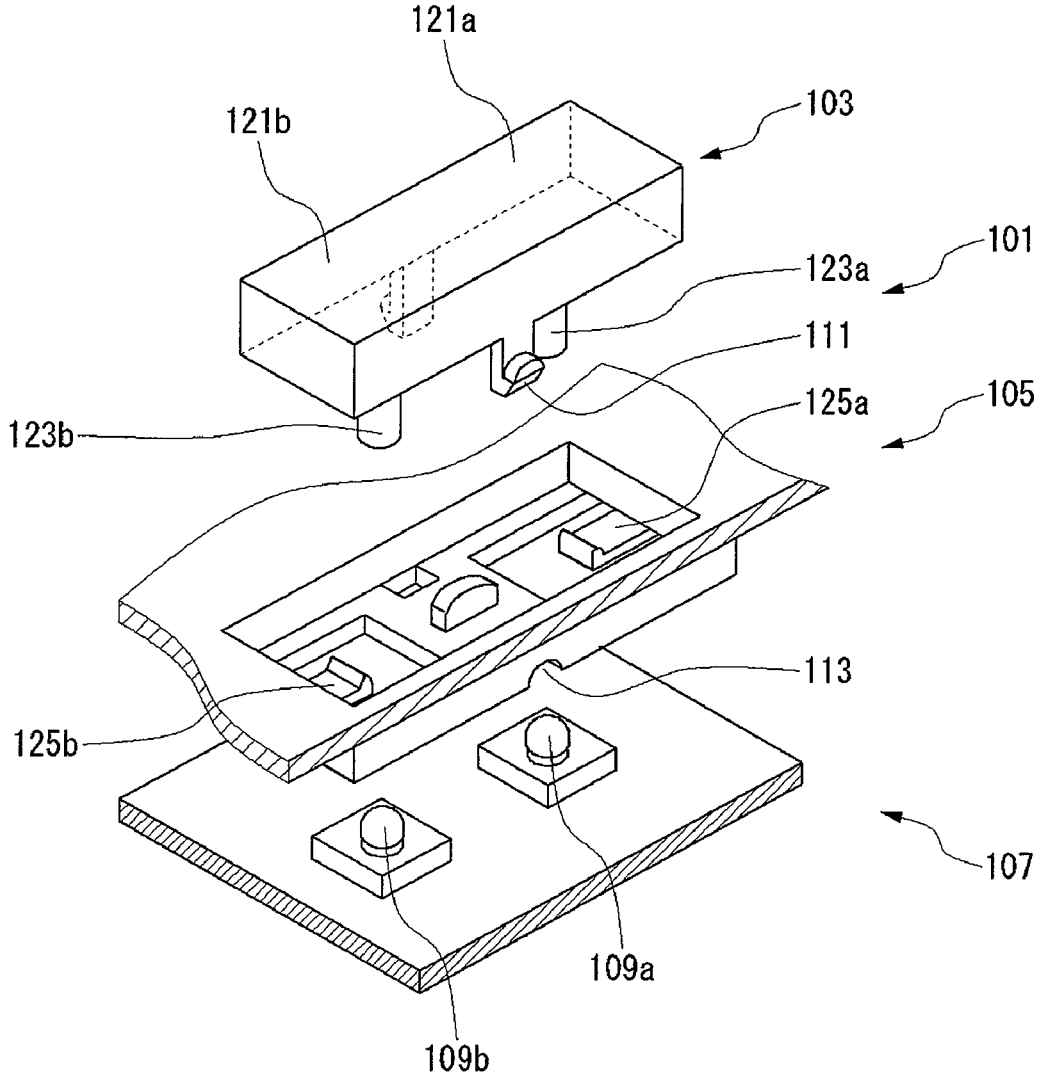
FIG. 12 is an exploded perspective view of the conventional electronic apparatus.

A supplementary description will be made on the utility of the invention resulting from the ability to do away with the above-mentioned conventional-art protrusion behind the button. As shown in FIGS. 11 and 12, the conventional apparatus has protrusions 125*a* and 125*b* that extend behind the operation button 103, in order to locate the operation button 103 in a predetermined position in the neutral state. The protrusions 125*a* and 125*b* are located near outer walls far from the center of rotation of the operation button 103 for structural reasons. Therefore, the protrusions 125*a* and 125*b* require to be considerably soft in order that the resistance of the button operation does not become too large. In order to obtain enough softness, it is required that the protrusions 125*a* and 125*b* be made considerably thin in thickness in the button pressing direction, and that the material of the protrusions 125*a* and 125*b* be considerably soft. However, if such protrusions 125*a* and 125*b* are to be provided, it is not easy to manufacture the button holding member 105. On the other hand, since the embodiment uses the hinge function of the board portion, members like the protrusions 125*a* and 125*b* are not required. Consequently, it is especially easy to manufacture compared to the conventional art.

The embodiment can further provide the below-described various advantages. First, since in the embodiment the operation button is tiltably held by the bending structure, it is not required to separately provide a structure for loading a pre-tension. The holding structure for the operation button can therefore be provided using less space. The operation button can also be reduced in size.

In the conventional art, the operation button is held by the rotation structure. The rotation structure formed of the pivot portion and the bearing portion tends to cause a rattle, and is disadvantageous from vibration and noise viewpoints. On the other hand, the above-described bending structure can hold the operation button in a predetermined position more reliably, so it is advantageous from vibration and noise viewpoints.

In the example of the embodiment, the electronic apparatus 1 is vehicle-mounted equipment, and more particularly is car audio equipment. Vehicle-mounted equipment such as car audio equipment is often exposed to vibrations. Holding the operation button reliably, the invention is particularly advantageous for such an application.

In the embodiment, as described before, the pressing portions 33*a* and 33*b* of the operation button 3 lightly push the switches 35*a* and 35*b* even in the neutral state, and thereby load a pre-tension. Both functions of the pre-tension and the board portion holding are helpful in holding the button in a predetermined position in the neutral state. Consequently, the operation button 3 can be held more reliably. This is particularly advantageous under a vibration environment of the above-mentioned vehicle-mounted equipment or the like.

In this regard, the pre-tension is not required to be loaded in the scope of the invention. Even when the pre-tension cannot be loaded, the invention allows the button to be held in a predetermined position by using the board portion, and is advantageous also in this respect.

A supplementary description related to the pre-tension will be made here. The pre-tension uses the stroke of the switches 35*a* and 35*b*. More particularly, the pre-tension is realized by utilizing the stroke section in which the contacts are not closed. For this reason, the pre-tension is a technique assuming that the stroke of the switch is long. If the switch stroke is short, the pre-tension cannot be loaded because the stroke section in which the contacts are not closed is extremely short or does not exist. In the invention, however, even if the pre-tension cannot be loaded, the operation button can be held in a position of a desired height by using the board portion with the fulcrum protrusions and claw portions, or can be located by inserting the board portion into the holding boss. This allows the operation button to be suitably held in a predetermined position. Similarly, the operation button can be suitably held in a predetermined position in a case where the pre-tension is not loaded due to a gap formed between the operation button and the switch caused by variations in component dimensions.

In the example of the embodiment, the tilt center is in approximately the center of the operation button 3, and is set near the position of the center of gravity. However, it is possible that the tilt center of the operation button is off the position of the center of gravity in order to meet requests regarding design or design layout. In the conventional-art rotation structure, if the tilt center is off the center of gravity of the button, the operation button tends to tilt even when it is in the neutral state, and this is disadvantageous from vibration and noise viewpoints. Particularly, in circumstances where the above-described pre-tension cannot be loaded, vibration and noise problems may be severe. In addition, the operation button may tilt in the neutral state, reducing the quality from a design viewpoint. On the other hand, the invention can reliably hold the operation button in a predetermined position by the holding structure using the board portion, even if the tilt center is off the center of gravity of the button. The invention is therefore advantageous from vibration and noise viewpoints, and is also advantageous from a design viewpoint.

A feeling of operation of the operation button 3 is mainly determined by a resistance of pushing the operation button 3. Conventionally, the feeling of operation would be determined by the pre-tension force. In the embodiment, however, the feeling of operation changes according to the stiffness of the board portion. This means that the feeling of operation can be easily adjusted by changing the stiffness of the board portion. Typically, the thickness of the board portion may be adjusted. As a result, the invention allows the feeling of operation to be easily adjusted, and is advantageous also in this respect.

In the aforementioned conventional art, the protruding member protrudes from the operation panel 5 and extends around to the back of the operation button. Such a protruding member takes a lot of space, and therefore becomes an obstacle to size reduction of the operation button and to placement of illumination components. In the invention, on the other hand, since the protruding member can be done away with, space can be efficiently utilized, the operation button can be reduced in size, and illumination components can be placed in a desired location.

In the embodiment, the partially abutting portion 51 at which the operation button 3 and the operation panel 5 are in partial contact with each other is provided adjacent to the board portion 41. This allows the partially abutting portion 51 to act as the tilt fulcrum and stabilizes the fulcrum of the tilt movement (seesaw movement), and the button operation can be reliably performed.

In the embodiment, the holding portion 15 is provided with the holding hole 45 and the board portion 41 is held inserted in the holding hole 45, the holding hole 45 being provided with the chamfered portion at the entrance portion thereof. This allows the board portion 41 to bend smoothly according to the tilt of the operation button 3 around the tilt fulcrum, and stress concentration in the board portion 41 can be reduced.

In the embodiment, the holding hole 45 is provided through the holding portion 15 and the board portion 41 has the claw portions 47*a* and 47*b*, the edge portion of the holding hole 45 and the claw portions 47*a* and 47*b* engaging with each other so that the operation button 3 is held by the holding portion 15. This allows the operation button 3 to be held by the operation panel 5 with the simple structure.

In the embodiment, the slit 49 is provided between the plurality of claw portions 47*a* and 47*b*. This allows the claw portions 47*a* and 47*b* to bend, and therefore the board portion 41 can be easily inserted into the holding hole 45 and assembly characteristics are improved. In addition, the height of the claw portions 47*a* and 47*b* can be increased, so the operation button 3 can be mounted on the operation panel 5 more reliably.

As for the board portion mounting structure, the configuration of the holding hole is not limited to the above-described example of the embodiment. For example, the holding hole may be a gap between members. That is, a mere gap between members, too, can provide the function of the holding hole, and may be included in the holding hole of the invention. Moreover, the board portion mounting structure is not limited to the above example. The board portion may be put between members. The board portion may also be held by adhesion. However, the board portion can be held easily and reliably by using the holding hole and, additionally, by providing the claw portions and the slit.

In the embodiment, the holding portion 15 is integrally formed on the operation panel 5. Consequently, the holding portion 15 can be realized with the simple configuration, the number of parts can be reduced, and assembly characteristics can be improved.

In the embodiment, the light-emitting portions 61*a* and 61*b* are provided near the switches 35*a* and 35*b*. The operation panel 5, in positions corresponding to the light-emitting portions 61*a* and 61*b*, has tubular portions 63*a* and 63*b* through which light passes from the light-emitting portions 61*a* and 61*b* toward the operating portions 31*a* and 31*b*. This allows the operation button 3 to be illuminated with light from the light-emitting portions 61*a* and 61*b*. As described before, since the obstructive protruding member behind the button which is seen in conventional apparatuses is not required, space can be efficiently utilized for illumination, and the operation button 3 can be suitably illuminated.

From another viewpoint, in the above-described electronic apparatus, the operation button and the holding portion of the button holding member are connected to each other via a bending member. Both ends of the bending member are fixed to the operation button and the holding portion, respectively. While the bending member is the board portion in the above example, the bending member may have a shape other than a board, and may be, for example, a rod-shaped member. Moreover, while the board portion bends in two directions in the above example, there may be two or more bending directions for the bending member. Furthermore, while the bending member is integrally formed on the operation button in the above example, the invention is not limited to this and the bending member may be integrally formed on the holding portion side. The bending member may also be made separately from the operation button and from the holding portion. With the simple structure having the bending member, the invention realizes the tiltable structure and the structure in which the operation button is held in the predetermined position in the neutral state. Consequently, also from this viewpoint, the invention can provide the electronic apparatus that has the simple structure and is easy to manufacture.

While there has been described what are at present considered to be preferred embodiments of the invention, it will be understood that various modifications and variations may be made thereto, and it is intended that appended claims cover all such modifications and variations as fall within the true spirit and scope of the invention.

INDUSTRIAL APPLICABILITY

As stated above, the electronic apparatus consistent with the invention has advantages of being able to simplify the structure and to facilitate the manufacture, and is useful as car audio equipment or other electronic apparatuses.

The invention claimed is:

1. An electronic apparatus comprising:

an operation button;

an operation panel provided with a holding portion for holding said operation button; and a plurality of switches to be pushed down by said operation button, wherein said operation button includes a face board portion having a plurality of operating portions;

a plurality of pressing portions respectively provided on said plurality of operating portions toward said plurality of switches; and a flat-shaped flexible board portion protruded backward from the backside of said face board portion between said plurality of pressing portions, said board portion of said operation button for being nipped by said holding portion.

2. The electronic apparatus according to claim 1, comprising a partially abutting portion placed at an edge wall portion of said operation button so as to provide partial contact between said operation button and said operation panel, wherein said partially abutting portion is adjacent to said board portion.

3. The electronic apparatus according to claim 1, wherein said holding portion consists of a hollow holding portion formed on said operating panel for accommodating said operation button, a holding hole is provided on a pillar-shaped holding boss extending from a bottom board portion of said hollow holding portion, said board portion is nipped by said holding boss by being inserted in said holding hole, and a chamfered portion is provided at an entrance portion of said holding hold.

4. The electronic apparatus according to claim 1, wherein a holding hole is provided through said holding portion, and said board portion has a claw portion so that said operation button is nipped by said holding portion by engaging an edge portion of said holding hole with said claw portion.

5. The electronic apparatus according to claim 4, wherein said board portion has a plurality of said claw portions, and a slit is provided between said plurality of claw portions.

6. The electronic apparatus according to claim 1, wherein said holding portion is integrally formed on said operation panel.

7. The electronic apparatus according to claim 1, wherein a light-emitting portion is provided near said switches, and said operation panel has a tubular portion in a position corresponding to said light-emitting portion so as to allow light to pass from said light-emitting portion to said operating portion.

8. An electronic apparatus comprising:

an operation button;

a button holding member provided with a holding portion for holding said operation button; and a plurality of switches to be pushed down by said operation button, wherein said operation button includes a plurality of operating portions and a plurality of pressing portions respectively provided on said plurality of operating portions toward said plurality of switches, said operation button and said holding portion are configured to be connected to each other between said plurality of pressing portions via a flexible bending member, both ends of said bending member being fixed to said operation button and said holding portion, respectively, bending of said bending member allows said operation button to tilt.

* * * * *